United States Patent [19]

Anthony et al.

[11] Patent Number: 4,692,970

[45] Date of Patent: Sep. 15, 1987

[54] BELT BUCKLE WITH EJECT MEANS

[75] Inventors: James R. Anthony, Carmel; Michael A. Wiseman, Whiteland, both of Ind.

[73] Assignee: Indiana Mills & Manufacturing, Inc., Carmel, Ind.

[21] Appl. No.: 920,285

[22] Filed: Oct. 17, 1986

Related U.S. Application Data

[63] Continuation-in-part of Ser. No. 762,451, Aug. 5, 1985 now U.S. Pat. No. 4,617,705.

[51] Int. Cl.[4] ..... A44B 11/26

[52] U.S. Cl. ..... 24/642; 24/632; 24/639

[58] Field of Search ..... 24/642, 632, 639, 656, 24/643, 664, 655, 635, 638, 640, 641

[56] References Cited

U.S. PATENT DOCUMENTS

| | | | |
|---|---|---|---|
| 3,256,576 | 6/1966 | Klove, Jr. et al. | 24/638 |
| 3,523,342 | 8/1970 | Spires | 24/643 |
| 3,605,210 | 9/1971 | Lohr | 24/635 |
| 3,760,467 | 9/1973 | Lohr | 24/639 |
| 4,128,924 | 12/1978 | Happel et al. | 24/632 |
| 4,196,500 | 4/1980 | Happel et al. | 24/632 |
| 4,228,567 | 10/1980 | Ikesue et al. | 24/642 |
| 4,425,688 | 1/1984 | Anthony et al. | 24/642 |
| 4,577,378 | 3/1986 | Harenberg | 24/639 |

*Primary Examiner*—Victor N. Sakran

*Attorney, Agent, or Firm*—Woodward, Emhardt, Naughton, Moriarty & McNett

[57] ABSTRACT

A buckle for receiving a tongue. A pair of helical springs are positioned between a latch and a main body having first slots for receiving one edge of a reinforcement plate pivoted downward depressing the latch springs and snapping into place into a yieldable hook shaped portion. A push button is positioned between the reinforcement plate and the cover having a skirt interferingly extending between the plate and main body securing the assembly together. The plate includes a pair of legs extending on opposite of the tongue mouth and into the main body transferring plate load into the main body of the buckle. The push button includes two legs fitting adjacent and inward of two arms of the latch in turn limiting outward travel of the button legs. An alternate embodiment includes a third leg depending from the plate. The preferred embodiment includes a rear tongue receiving channel formed by an extension of the reinforcement plate in which is located a leaf spring providing withdrawal assist force against the tongue.

20 Claims, 11 Drawing Figures

BELT BUCKLE WITH EJECT MEANS

CROSS REFERENCE TO RELATED APPLICATION

This application is a continuation-in-part of U.S. patent application Ser. No. 762,451, filed Aug. 5, 1985, now U.S. Pat. No. 4,617,705.

BACKGROUND OF THE INVENTION

A variety of seat belt buckles have been devised to maximize holding capability as well as to improve the cost and ease of manufacture. For example, the U.S. Pat. No. 4,128,924 issued to Herman E. Happel and James R. Anthony discloses a buckle having a pair of reinforcing plates attached to the cover and main body for strengthening the buckle. The buckle includes a spring biased latch urged upwardly to lockingly receive a seat belt tongue. The bottom plate includes a downwardly offset portion at the buckle mouth to provide a guide for the tongue being inserted into the buckle mouth. The same inventors are named in U.S. Pat. No. 4,196,500 which discloses the same type of spring biased latch held captive beneath a block attached between the buckle main body and the buckle cover. An earlier design including a spring biased latch operated by a pivoting handle secured to the buckle main body is disclosed in the U.S. Pat. No. 3,760,467. The U.S. Pat. No. 4,425,688 issued to James R. Anthony and Allan R. Lortz discloses a child belt buckle including a reinforcing plate mounted to a bottom main body and enclosing a spring biased latch with the cover and operator button being located atop the plate.

It is desirable to distribute the force applied to the latch by the tongue in as many directions and over as wide an area as possible. Many of the prior art buckles utilizing reinforcing plate typically distribute the force along the longitudinal axis of the buckle or in the direction of the tongue axis with the result that large forces are applied to the outer walls of the buckle. In the event that the buckle main body is produced of plastic, then failure of the buckle main body is possible. Thus, the plates have been fastened by rivets and assorted fasteners, including plastic projections, to the cover and buckle main body. Disclosed herein is a buckle incorporating a reinforcing plate having support legs which extend perpendicular from the plate and against support surfaces located both in the front and back of the buckle main body thereby transferring some of the force into other areas of the buckle main body. A particular advantage of the design disclosed herein is the positioning of the reinforcing plate atop the tongue mouth of the buckle with the plate legs depending therefrom along the opposite sides of the mouth and then extending partially across the bottom of the mouth defining the mouth perimeter.

Many prior art buckles including the latch buttons are produced from plastic whereas the latch within the buckle is produced from metal. As a result, considerable stress is placed on the button due to the rigidity of the latch. The latch button disclosed herein includes two depending legs position within and against two upwardly extending arms of the latch. The latch arms retain and keep the legs from bowing outwardly as pressure is applied to the button.

In the latest design disclosed herein, a leaf spring is positioned at the aft end of the tongue receiving cavity within the buckle main body to apply withdrawal assist force against the tongue when fully inserted into the buckle. Eject spring have been previously utilized in a variety of buckles. For example, the U.S. Pat. No. 3,523,342 discloses a pair of helical springs located at the aft end of the buckle for urging a split tongue to separate and move from the buckle. Other U.S. Patents cited during the prosecution of the parent application include U.S. Pat. Nos. 3,256,576, 3,605,210 and 4,228,567.

SUMMARY OF THE INVENTION

One embodiment of the present invention is a buckle comprising a reinforcement plate having a longitudinal axis extending through a longitudinal plane and further having legs with distal ends, a main body having the plate mounted thereto and including stop surfaces receiving the distal ends and limiting relative movement between the plate and main body, the main body includes yieldable means integral therewith for engaging the plate, the yieldable means being moveable to allow the plate to be inserted in the main body and then moveable back holding the plate therein, a latch positioned in the main body and held captive therein by the plate, the latch moveable between a latch position and an unlatched position, spring means contacting the latch to move the latch back and forth between the latch position and the unlatched position, operator means operable to move the latch to the unlatched position, a cover mounted to the main body and cooperatively forming a mouth therewith, the plate extending adjacent the mouth with the cover enclosing the latch, the spring means and the plate, the cover including securing means extending between the plate and the main body securing the cover to the main body, and limit means depending from the plate within the main body and spaced apart aft of the mouth and including tongue stop surfaces to limit movement of the tongue when the tongue is in the buckle.

Another embodiment of the present invention is a buckle lockingly engageable with a tongue comprising a reinforcement plate having opposite end portions with a longitudinal plane extending therebetween, the plate including a pair of legs with distal ends, the legs extending in a direction transverse to the plane to support the plate in the direction, a main body having the plate mounted thereto, the main body having locking means engaging the opposite end portions of the plate securing the plate thereto and limiting movement of the plate relative to the main body along the plane, the main body including stop surfaces receiving the legs limiting movement of the plate relative to the main body in the direction, a latch positioned in the main body and held captive therein by the plate, spring means positioned in the main body being operable to move the latch, operator means operably engaged with the latch for movement thereof, a cover mounted to the main body and enclosing the plate, the cover and the main body cooperatively forming a mouth and having a plate extending thereby, and limit means depending from the plate within the main body and spaced apart aft of the mouth and including tongue stop surfaces to limit movement of the tongue when the tongue is in the buckle.

Yet a further embodiment of the present invention is a belt buckle comprising a main body member having a body cavity therein, a cover member adapted to overlie the body member having a cavity therein registering with the body cavity, movable latching means for engaging a belt tongue, manual operating means accessible at the exterior of the cover member for actuating the latching means, and wherein the main body member and cover member form an entry passage for a belt tongue into the body cavity, a reinforcing plate extending through a longitudinal plane with the plate having an end portion offset adjacent the entry passage to accommodate entry of a belt tongue into the body cavity with the end portion including a pair of legs extending away from the reinforcing plate and having a distal end means contacting the main body limiting relative motion between the reinforcing plate and the body member, and eject means mounted in the buckle operable to apply withdrawal force to the tongue when the tongue is fully within the body cavity.

It is an object of the present invention to provide a buckle having a reinforcing plate located above the tongue mouth with depending legs supportingly received by support surfaces within the bottom portion of the buckle.

Another object of the present invention is to provide a new and improved buckle.

Related objects and advantages of the present invention will be apparent from the following description.

DESCRIPTION OF THE PREFERRED EMBODIMENTS

Figure 1:
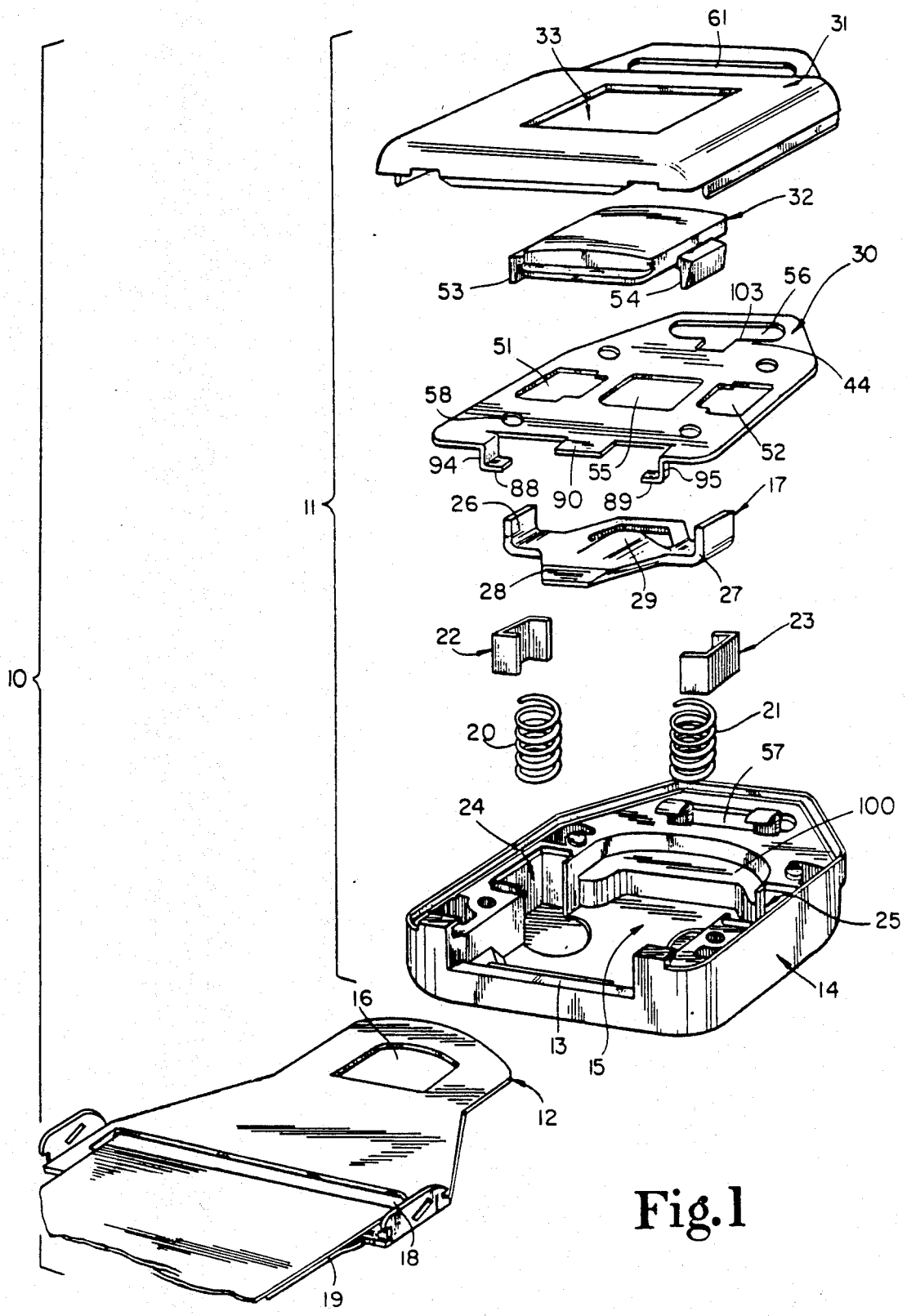
FIG. 1 is an exploded perspective view of an alternate embodiment of the buckle and tongue combination incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a buckle tongue combination 10 consisting of a buckle 11 shown in exploded view and a buckle tongue 12. Buckle 11 includes a main body 14 having a mouth 13 for receiving the leading edge of tongue 12 which extends into a cavity 15 formed in main body 14. Tongue 12 includes an aperture 16 through which an upraised portion of latch 17 projects. Tongue 12 includes a second aperture 18 with web 19 extending therethrough and being fixedly attached to the tongue. A pair of helical springs 20 and 21 rest within cavity 15 and urge latch 17 to the upward position whereat the latch is locked to tongue 12. Alternately, a single spring may be utilized in lieu of springs 20 and 21 to urge the latch upwardly. In the event that a single spring is utilized, then the spring is located centrally beneath latch 17. A pair of channels 22 and 23 are secured within complementary sized cavities 24 and 25 opening into main cavity 15. Channels 22 and 23 slidably receive the mutually opposed and upturned arms 26 and 27 of latch 17. The forward edge 28 of latch 17 is beveled downwardly to guide tongue 12 toward the upraised portion 29 which is extendable through aperture 16. Springs 20 and 21 are positioned between the bottom wall of main body 14 forming cavity 15 and the undersurface of latch 17. A reinforcement plate 3O having a longitudinal axis extending through a longitudinal plane is attached to main body 14. Push button 32 is located between cover 31 and plate 30 and is projectable partially through aperture 33 of cover 31 to allow the operator to depress the button thereby depressing latch 17 to the downward or unlocked position.

Main body 14 (FIG. 2) may be made from a material such as plastic. Main body 14 includes a pair of spring cavities 34 and 35 opening respectively into the channel receiving cavities 24 and 25. A pair of conventional helical springs 20 and 21 (FIG. 1) are positioned within cavities 34 and 35 contacting the bottom surface of latch 17. Optional pins 36 through 39 are secured to main body 14 and extend upwardly through plate 30 and into cover 31. Positioned on the opposite sides of mouth 13 are a pair of upwardly extending arms 40 and 41 having an aligned channel 42 (FIG. 3) facing and opening rearwardly. The leading edge 43 of plate 30 is first inserted into channels 42 and then pivoted downwardly thereby forcing the latch downward compressing springs 20 and 21 until edge portion 44 snaps into the pair of forward facing and opening grooves 45 provided in upstanding arms 46 and 47 integrally attached to main body 14. Each arm 46 and 47 is sufficiently flexible to move outwardly when the leading edge 44 contacts the cam surface 48 of each arm. Further pivoting downward of plate 30 into grooves 45 allows arms 46 and 47 to move back to their original position securing the plate in its final resting position. Each arm 46 and 47 has a top hook shaped edge 50 which overlaps the top surface of plate 30 securing the plate in the grooves. Additional support means or walls 81 and 82, located between grooves 42 and 45, project up from main body 14 and support plate 30.

Figure 7:
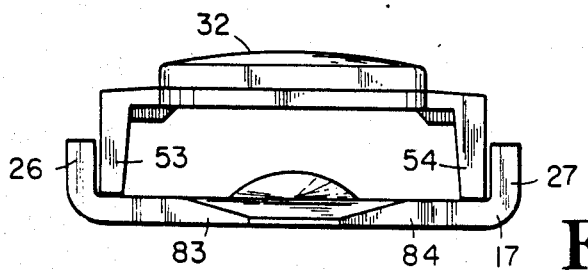
FIG. 7 is front view of the push button atop the latch with the remaining structure removed for purposes of clarity.

Plate 30 (FIG. 1) includes a pair of apertures 51 and 52 aligned with cavities 24 and 25 to receive the downwardly extending button legs 53 and 54 which project through the plate contacting latch 17 inwardly of the upwardly extending arms 26 and 27. Legs 53 and 54 contact respectively the flat outwardly extending portions 83 and 84 of latch 17 (FIG. 7). Button 32 and legs 53 and 54 are produced of plastic whereas the latch 17 and arms 26 and 27 are produced of metal. Thus, as downwardly pressure is applied to button 32 and transferred from legs 53 and 54 to latch 17 it is normally possible for the legs 53 and 54 to bow outwardly; however, the arms 26 and 27 being located immediately outward and adjacent the legs 53 and 54 prevent outward movement or bowing of the legs.

A third aperture 55 is provided in plate 30 between apertures 51 and 52 with the upward raised portion 29 of the latch engaging aperture 16 of tongue 12. A fourth aperture 56 is formed rearwardly of edge 44 and is aligned with aperture 57 of main body 14 and aperture 61 of cover 31 to allow a seat belt to be attached to the buckle. A plurality of apertures 58 are located around the peripheral portion of plate 30 to receive a plurality of pins extending through the plate and into main body 14 and cover 31 to provide additional strengthening means securing the cover, plate and main body together.

Figure 2:
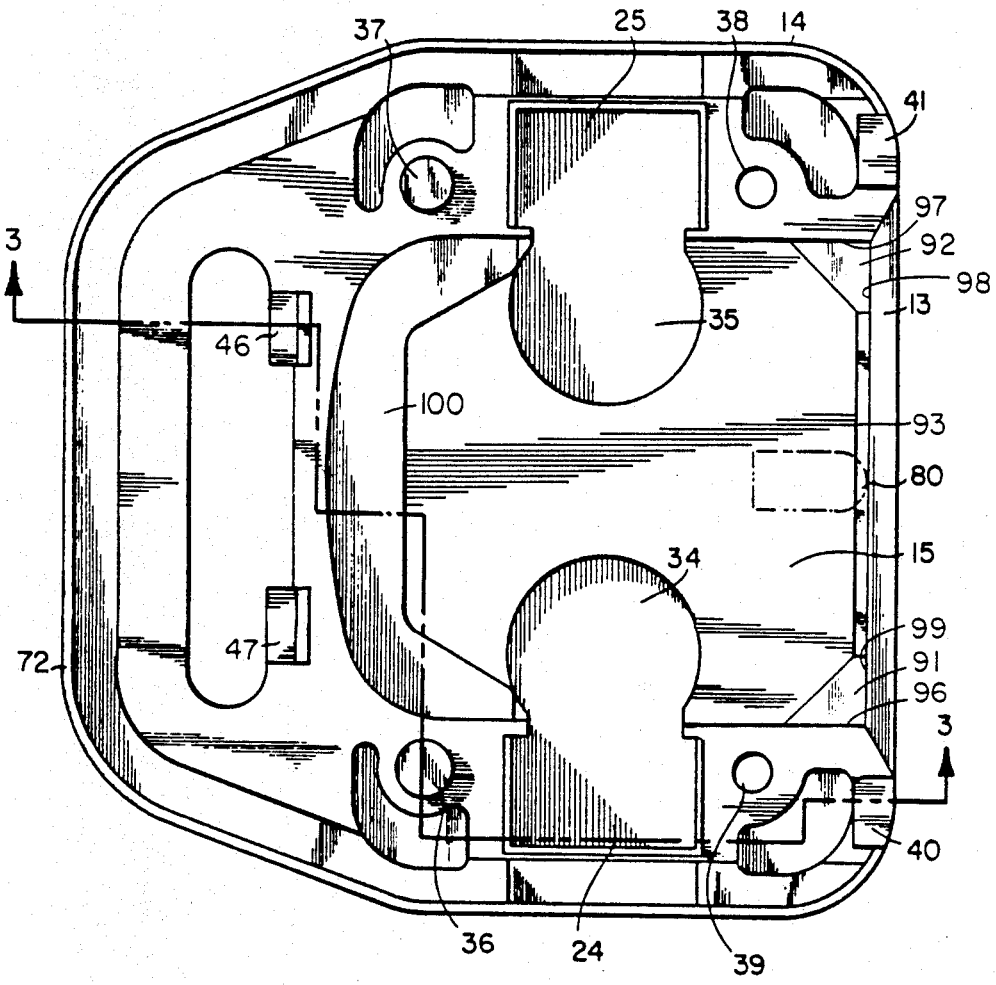
FIG. 2 is a top view of the main body of the buckle.
Figure 3:
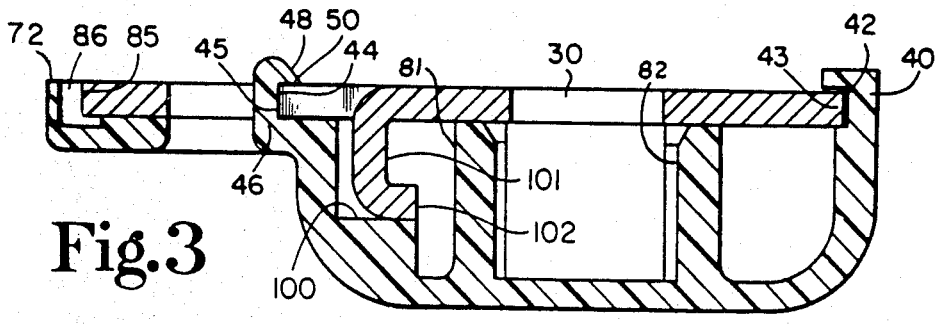
FIG. 3 is a cross-sectional view viewed in the direction of the arrows 3—3 of FIG. 2 showing the reinforcement plate in position.
Figure 5:
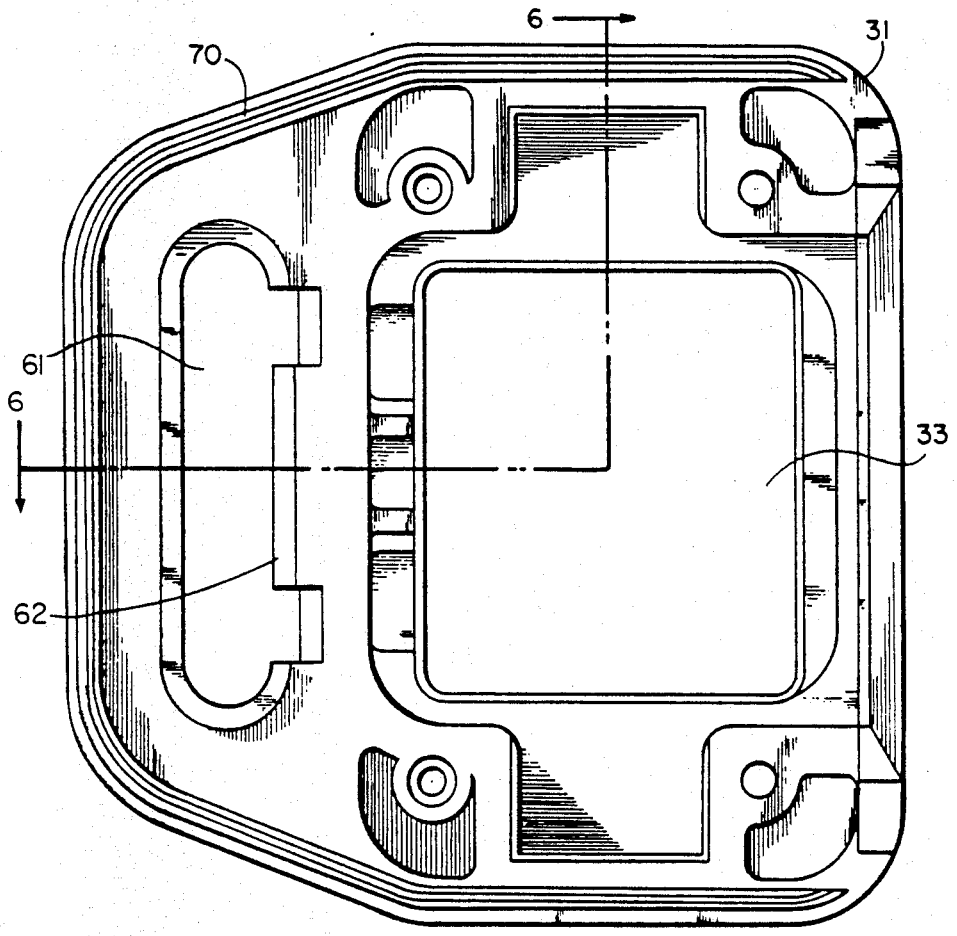
FIG. 5 is a bottom view of the buckle cover.
Figure 6:
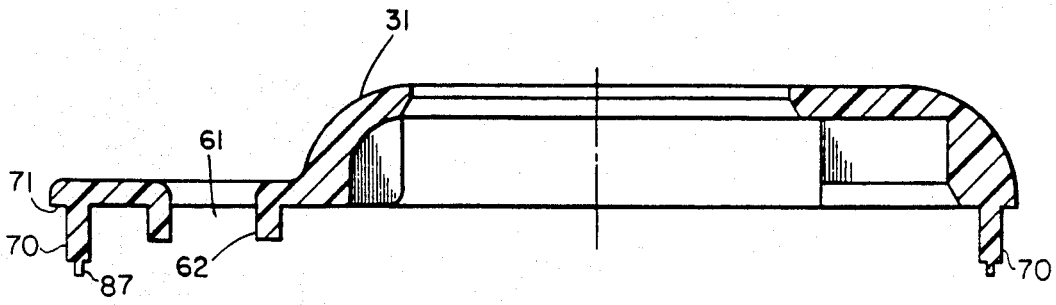
FIG. 6 is a cross-sectional view viewed in the direction of the arrows 6—6 of FIG. 5.

Cover 31 is snapped onto and held to plate 30 and main body 14 by means of a downwardly extending skirt on the cover which fits interferingly between the edge of the main body and the edge of the plate. Skirt 70 (FIG. 5) extends around the periphery of cover 31 except at the front thereof terminating immediately adjacent and outward of arms 40 and 41 of main body 14 (FIG. 2). Skirt 70 is located inward of the periphery of the cover forming an outwardly extending flange 71 (FIG. 6) which rests atop the upwardly extending ridge 72 (FIG. 2). Plate 30 has an outer edge 85 (FIG. 3) spaced apart from ridge 72 forming a channel 86 extending rearwardly from arms 40 and 41 with channel 86 having a width less than the thickness of skirt 70. To install the cover onto the main body, the skirt 70 is interferingly forced into channel 86 causing the plate edge and ridge to tightly hold onto the skirt securing the cover to the buckle main body. The skirt 70 includes a reduced thickness distal end 87 (FIG. 6) to facilitate the guiding of the skirt into the channel. Extension 62 (FIGS. 5 and 6) is integrally attached to the cover and extends downwardly being located immediately forward of aperture 61 and atop the main body between the arms 46 and 47.

Figure 4:
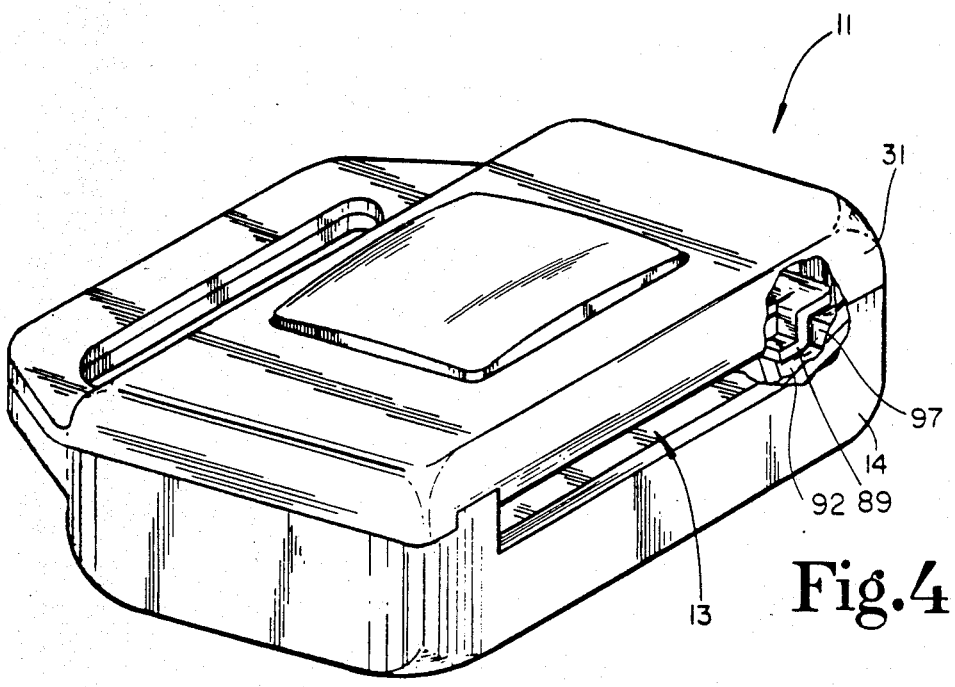
FIG. 4 is a fragmentary perspective view of the buckle of FIG. 1 showing the reinforcement plate relative to the main body.

A fragmentary front perspective view of buckle 11 is shown in FIG. 4 illustrating the downwardly extending legs of the plate being supportingly received by upwardly facing support surfaces of the main body thereby transferring load from the plate to the main body and forming a metal guide extending at least partially around the tongue mouth formed in the buckle. Plate 30 includes a forward edge having a pair of downwardly extending legs 88 and 89 (FIG. 1). Legs 88 and 89 have respectively downwardly extending portions 94 and 95 perpendicularly arranged to the plate and distal ends turned inwardly to each other being parallel to the plate. The legs are formed from the leading edge of the plate leaving a center portion 90 positioned therebetween. The main body 14 of the buckle forms with the cover a tongue mouth 13 which has a upwardly extending edge 93 (FIG. 2) reduced in thickness at the opposite ends of the mouth whereat two horizontal stop or support surfaces 91 and 92 are positioned above the floor of the cavity 15. The inward turned distal ends of legs 88 and 89 are positioned atop and in contact with surfaces 91 and 92 thereby transferring load from the plate into the main body 14. Portions 94 and 95 of the legs extend along the vertical opposite ends of the mouth 13 whereas the distal ends of the legs extend partially along the bottom edge of the mouth. Likewise, portion 90 of plate 30 extends partially along the upper edge of the mouth with the plate extending across and atop the mouth. Legs 88 and 89 extend interiorly against main body 14 limiting movement of plate 30 in the direction of a horizontal plane containing the longitudinal axis of the plate. Vertical portions 94 and 95 of the legs contact vertical surfaces 96 and 97 extending above horizontal surfaces 91 and 92 and further contact surfaces 98 and 99 of edge 93 thereby limiting movement of the plate in the direction of the longitudinal axis of the plate.

Plate 30 includes a third downwardly extending leg 101 (FIG. 3) positioned along the center line of the plate and at the forward edge 103 of opening 56. Leg 101 has a distal end 102 extending toward the buckle mouth which rests atop support surface 100 located above the buckle main body floor. End 102 in cooperation with the main body of the plate form a recess opening toward and aligned with the mouth 13 of the buckle receiving the forward edge of the tongue 12 when inserted into the buckle mouth. Thus, leg 101 distributes force from the plate into the buckle main body while serving as a stop for the tongue.

Figure 8:
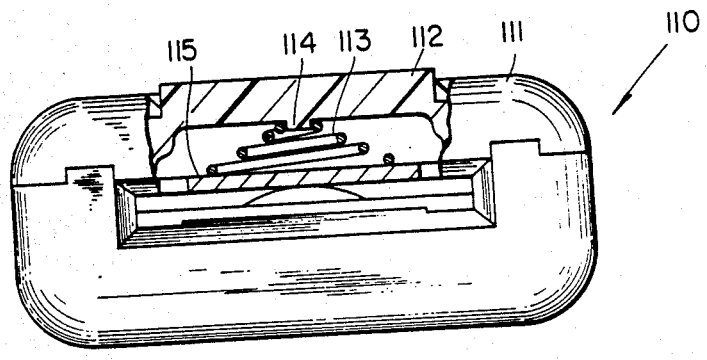
FIG. 8 is a fragmentary front view of a further alternate embodiment of the buckle with an additional spring located between the push button and reinforcement plate.
Figure 9:
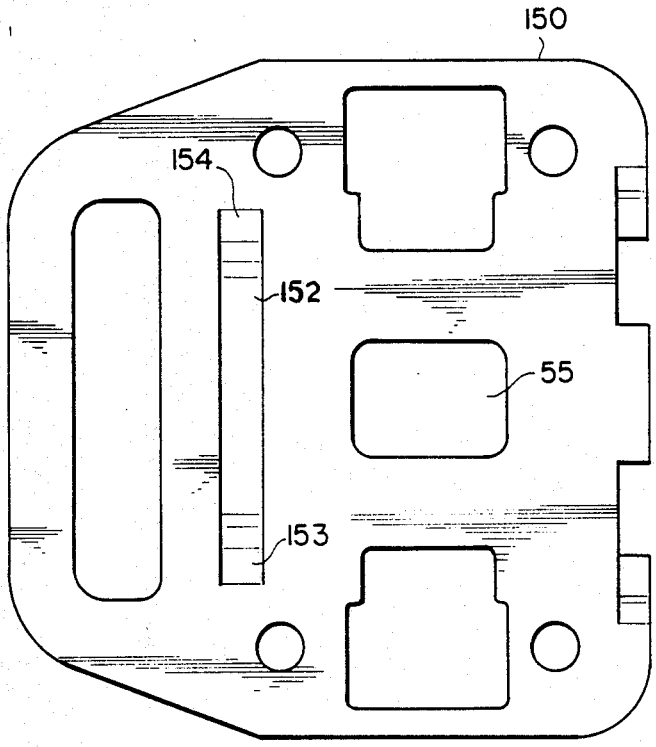
FIG. 9 is a plan view of the reinforcement plate utilized in the preferred embodiment of the buckle.
Figure 10:
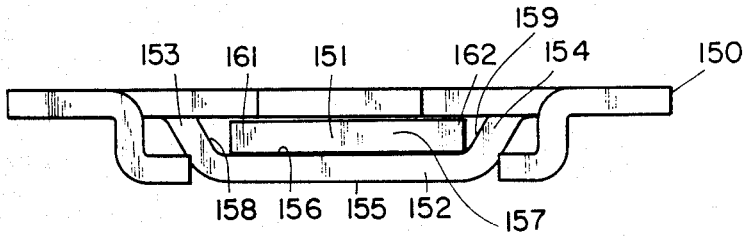
FIG. 10 is an end view of the plate of FIG. 9 with a leaf spring associated therewith.
Figure 11:
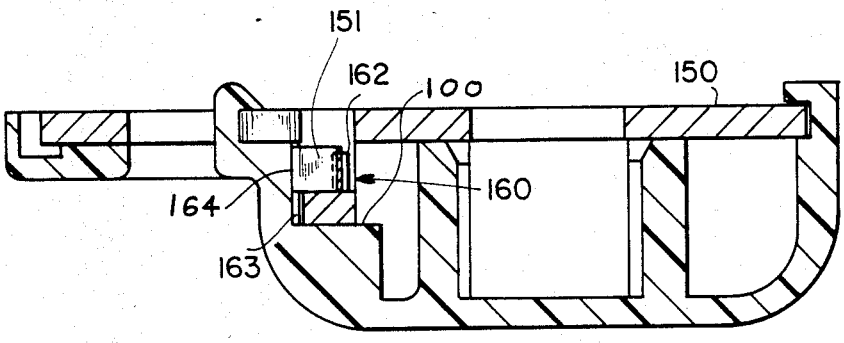
FIG. 11 is the same view as FIG. 3 only showing the reinforcement plate of FIG. 9 with a leaf spring mounted in the buckle main body.

Many variations are contemplated and included in the present invention. For example, a tongue separated into two pieces may be utilized in lieu of the single tongue 12 shown in FIG. 1. In such a case, a partition wall 80 extends upwardly from the bottom wall of main body 14 (FIG. 2) being located at the midpoint of mouth 13. The partition wall 80 is shown in dashed lines to illustrate that it should be removed in case a single tongue 12 is utilized as depicted in FIG. 1. Further, a downward extension is provided on push button 32 to further divide mouth 13 into two separate equal parts in case a dual tongue is utilized. The downward extension is not provided on the push button in case a single tongue is provided. An additional helical spring may be utilized with springs 20 and 21 to further increase the amount of spring force. In such a case, the third spring would be located between and rearwardly of springs 20 and 21. An alternate embodiment of the buckle is identical to the buckle herein described with the exception that a third spring is located between the push button and the reinforcement plate. Buckle 110 is shown fragmented in the front view of FIG. 8 and includes a third spring 113 positioned in the cover 111 between the push button 112 and the reinforcement plate 115 increasing the amount of force required to depress the push button. Push button 112 includes a center projection 114 extending downwardly upon which the top reduced diameter end of a helical spring is mounted with the opposite enlarged end of the spring resting atop the plate 115. Plate 115 is identical with plate 30 with exception that plate 115 does not include opening 55. The springs between the latch and the buckle main body apply a first force against the latch in an upward direction against the latch whereas spring 113 applies a second force against the push button in the same upward direction. All of the springs are yieldable to allow the latch and push button to move in a downward direction. Thus, when finger pressure is applied to the push button of a predetermined amount exceeding the sum of the first force and second force, then the latch will move apart from the belt tongue allowing the tongue to be withdrawn from the buckle.

The preferred embodiment of the buckle is identical to the buckle shown in FIG. 1 with the exception that reinforcement plate 150 is utilized in lieu of reinforcement plate 30 and with the further exception that a leaf spring 151 is positioned beneath the reinforcement plate to apply a withdrawal assist force to the leading edge of the buckle tongue.

Reinforcement plate 150 is identical to plate 30 except that the leg 101 is replaced by a downwardly extending bridge 152 having a pair of top end portions 153 and 154 integrally connected to plate 150. Bridge 152 is positioned over support surface 100 and has a bottom surface 155 resting thereon limiting relative motion between the plate and the buckle main body. The top surface 156 of bridge 152 is spaced apart from the bottom surface of plate 150 thereby forming a tongue receiving channel 157 located aft of the buckle mouth and having side boundries defined by the inwardly facing tongue stop surfaces 158 and 159 respectively of top end portions 153 and 154. Stop surfaces 158 and 159 are positioned adjacent the longitudinal extending edges of tongue 12 when the tongue is fully inserted in the buckle thereby cooperatively with the bottom facing surface of plate 150 and surface 156 of bridge 152 preventing rotation of the tongue in the buckle and increasing the torsional strength of the buckle/tongue combination.

A conventional leaf spring 151 is positioned within channel 157 between the bottom surface of plate 150 and surface 156 with the leaf spring having a center portion 160 bowed forwardly to contact the leading edge of tongue 12 as the tongue is inserted into the buckle forcing the leaf spring center portion 160 rearwardly. The opposite ends 161 and 162 of the leaf spring are positioned in slots 163 formed in surface 164 of the buckle main body next to respectively top end portions 153 and 154 of bridge 152. Thus, the leaf spring has a convex configuration as viewed from the mouth of the buckle. A pair of pins 162 are mounted into surface 100 forward of but adjacent the opposite ends of the leaf spring preventing disengagement of the opposite ends of the leaf spring from slots 163. In an alternate embodiment, the leaf spring has an inverted L-shaped configuration with the horizontally extending portion of the spring being affixed atop plate 150 aft of bridge 152 and with remaining portion of the spring extending vertically downward above bridge 152 and into the tongue receiving channel 157 to contact the forward edge of the tongue when the tongue is inserted in the buckle. The leaf spring provides a withdrawal assist force against the tongue, providing precise release forces and improving the release force consistency.

The preferred embodiment of the buckle includes the leaf spring 151 and reinforcement plate 150. In addition, the preferred embodiment utilizes one, two or three helical springs beneath the latch with or without the additional spring 113 positioned above the reinforcement plate 150. In the event that spring 113 is utilized, then aperture 55 is not provided on plate 150.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A buckle comprising:

a reinforcement plate having a longitudinal axis extending through a longitudinal plane and further having legs with distal ends;

a main body having said plate mounted thereto and including stop surfaces receiving said distal ends and limiting relative movement between said plate and main body, said main body includes yieldable means integral therewith for engaging said plate, said yieldable means being moveable to allow said plate to be inserted in said main body and then moveable back holding said plate therein;

a latch positioned in said main body and held captive therein by said plate, said latch moveable between a latch position and an unlatched position;

spring means contacting said latch to move said latch back and forth between said latch position and said unlatched position;

operator means operable to move said latch to said unlatched position;

a cover mounted to said main body and cooperatively forming a mouth therewith, said plate extending adjacent said mouth with said cover enclosing said latch, said spring means and said plate, said cover including securing means extending between said plate and said main body securing said cover to said main body; and, limit means depending from said plate within said main body and spaced apart aft of said mouth and including tongue stop surfaces to limit movement of said tongue when said tongue is in said buckle.

2. The buckle of claim 1 wherein said limit means includes a wall integrally depending downward from said plate defining a tongue receiving groove, said stop surfaces are on said wall and are mutually facing inwardly to contact said tongue when said tongue is positioned in said groove to increase torsional strength of said buckle.

3. The buckle of claim 1 and further comprising an eject spring mounted in said main body adjacent said limit means being operable to apply force against said tongue to assist withdrawal of said tongue from said buckle.

4. The buckle of claim 2 and further comprising an eject spring mounted in said main body adjacent said limit means and extendable into said tongue receiving groove to apply force against said tongue as said tongue is inserted into said groove applying withdrawal force against said tongue.

5. The buckle of claim 1 wherein said main body includes an internal groove mountingly receiving one end of said plate, said yieldable means includes a hook shaped portion forming a second groove aligned with said internal groove and receiving an other end of said plate opposite said one end.

6. The buckle of claim 5 wherein said latch includes outer upwardly extending arms whereas said operator means includes depending supports resting atop said latch and positioned inwardly of said upwardly extending arms with said arms limiting outward travel of said supports.

7. A buckle lockingly engageable with a tongue comprising:

a reinforcement plate having opposite end portions with a longitudinal plane extending therebetween, said plate including a pair of legs with distal ends, said legs extending in a direction transverse to said plane to support said plate in said direction;

a main body having said plate mounted thereto, said main body having locking means engaging said opposite end portions of said plate securing said plate thereto and limiting movement of said plate relative to said main body along said plane, said main body including stop surfaces receiving said legs limiting movement of said plate relative to said main body in said direction;

a latch positioned in said main body and held captive therein by said plate;

spring means positioned in said main body being operable to move said latch;

operator means operably engaged with said latch for movement thereof;

a cover mounted to said main body and enclosing said plate, said cover and said main body cooperatively forming a mouth and having said plate extending thereby; and, limit means depending from said plate within said main body and spaced apart aft of said mouth and including tongue stop surfaces to limit movement of said tongue when said tongue is in said buckle.

8. The buckle of claim 7 wherein said main body is hookingly engaged with said plate securing said plate thereto.

9. The buckle of claim 7 wherein:

said legs each have a leg portion perpendicularly arranged to said plane and a distal end integrally attached to said leg portion and extending parallel to said plane; and, said stop surfaces are arranged to contactingly receive said leg portion and distal end limiting movement of said plate in a direction perpendicular to said plate.

10. The buckle of claim 7 and further comprising a leaf spring mounted in said main body adjacent said limit means and positioned to contact said tongue when said tongue is positioned within said main body to apply force thereagainst.

11. The buckle of claim 10 wherein said limit means includes a pair of depending arms integrally attached to said plate and resting against said main body defining a tongue receiving channel aft of said mouth to cooperatively with said pair of legs limit rotation of said tongue in said buckle.

12. The buckle of claim 7 wherein:

said main body and cover form a tongue receiving mouth with a top and bottom edge and side edges; and, said plate extends along said top edge and said legs extend from said plate along said side edges and partially along said bottom edge of said mouth providing a tongue guide.

13. A belt buckle comprising:

a main body member having a body cavity therein;

a cover member adapted to overlie said body member and having a cavity therein registering with the body cavity;

movable latching means for engaging a belt tongue;

manual operating means accessible at the exterior of the cover member for actuating said latching means, and wherein said main body member and cover member form an entry passage for a belt tongue into said body cavity;

a reinforcing plate extending through a longitudinal plane with said plate having an end portion offset adjacent said entry passage to accommodate entry of a belt tongue into the body cavity with said end portion including a pair of legs extending away from said reinforcing plate and having distal end means contacting said main body limiting relative motion between said reinforcing plate and said body member; and, eject means, mounted in said buckle and including a spring against which said tongue contacts when said tongue is fully within said body cavity, operable to apply withdrawal force to said tongue when said tongue is fully within said body cavity.

14. The buckle of claim 13 wherein said eject means includes a leaf spring mounted in said body member projecting forward toward said entry passage and further comprising a wall integrally depending from said plate adjacent said leaf spring and defining a tongue receiving channel into which said tongue projects against said leaf spring when fully inserted in said buckle.

15. The buckle of claim 13 and further comprising:

a spring located between said plate and said operating means and providing spring force to said operating means.

16. A belt buckle comprising:

a main body member having a cavity therein with an entry passage;

a cover member mounted on said body member;

movable latching means mounted in said main body member for engaging a belt tongue inserted in the buckle;

manual operating means accessible at the exterior of the cover member and engaged with said latching means being movable upon receipt of a predetermined amount of finger force to move said latching means relative to said belt tongue;

first spring means mounted in said main body member and positioned between said main body and said movable latching means being operable to normally apply a first force against said movable latching means in a first direction moving same into engagement with said belt tongue when inserted into the buckle but yieldable to allow movement of said movable latching means away from said belt tongue in a second direction opposite of said first direction;

second spring means positioned adjacent said manual operating means operable to normally apply a second force against said manual operating means in said first direction but yieldable to allow movement of said manual operating means in said second direction when said finger force exceeds the sum of said first force and said second force;

a reinforcing plate extending through a longitudinal plane and having an end portion offset adjacent said entry passage to accommodate entry of a belt tongue into the body member cavity with said end portion including a pair of legs extending away from said reinforcing plate and having a distal end means contacting said main body member limiting relative motion between said reinforcing plate and said main body member in a direction perpendicular to said plane; and, additional leg means mounted to said reinforcing plate and extending away therefrom having additional distal end means contacting said main body member operable to limit relative motion between said reinforcing plate and said main body member and to limit motion between said tongue and said reinforcing plate.

17. A belt buckle comprising:

a main body member having a cavity therein with an entry passage;

a cover member mounted on said body member;

movable latching means mounted to said main body member for engaging a belt tongue inserted in the buckle;

manual operating means accessible at the exterior of the cover member and engaged with said latching means being movable upon receipt of a predetermined amount of finger force to move said latching means relative to said belt tongue;

spring means mounted in said body member and positioned between said body member and said movable latching means being operable to normally apply a first force against said movable latching means in a first direction moving same into engagement with said belt tongue when inserted into the buckle but yieldable to allow movement of said movable latching means away from said belt tongue in a second direction opposite of said first direction;

a reinforcing plate extending through a longitudinal plane with said plate mounted to said body member and having an end portion offset adjacent said entry passage to accommodate entry of a belt tongue into the body member cavity with said end portion including a pair of legs extending away from said reinforcing plate and having distal end means contacting said main body in two locations limiting relative motion between said reinforcing plate and said body member in a direction perpendicular to said plane; and, a guide depending from said plate defining a tongue guide to receive said tongue when fully inserted into said buckle, said guide including a pair of mutually facing stop surfaces extending downwardly from said plate providing limits for movement of said tongue in a plane parallel to said longitudinal plane.

18. The buckle of claim 17 and further comprising additional spring means within said body member operable to apply withdrawal force against said tongue.

19. A buckle lockingly engageable with a tongue comprising:

a reinforcement plate having opposite end portions with a longitudinal plane extending therebetween, said plate including a pair of legs with distal ends, said legs extending in a direction transverse to said plane to support said plate in said direction;

a main body having said plate mounted thereto, said main body having locking means engaging said opposite end portions of said plate securing said plate thereto and limiting movement of said plate relative to said main body along said plane, said main body including stop surfaces receiving said legs limiting movement of said plate relative to said main body in said direction;

a latch positioned in said main body and held captive therein by said plate;

spring means positioned in said main body being operable to move said latch;

operator means operably engaged with said latch for movement thereof;

a cover mounted to said main body and enclosing said plate, said cover and said main body cooperatively forming a mouth and having said plate extending thereby; and, limit means depending from said plate within said main body and spaced apart aft of said mouth and including a tongue stop surface to limit movement of said tongue when said tongue is in said buckle.

20. A belt buckle comprising:

a main body member having a cavity therein with an entry passage;

a cover member mounted on said body member;

movable latching means mounted in said main body member for engaging a belt tongue inserted in the buckle;

manual operating means accessible at the exterior of the cover member and engaged with said latching means being movable upon receipt of a predetermined amount of finger force to move said latching means relative to said belt tongue;

first spring means mounted in said main body member and positioned between said main body and said movable latching means being operable to normally apply a first force against said movable latching means in a first direction moving same into engagement with said belt tongue when inserted into the buckle but yieldable to allow movement of said movable latching means away from said belt tongue in a second direction opposite of said first direction;

second spring means positioned adjacent said manual operating means operable to normally apply a second force against said manual operating means in said first direction but yieldable to allow movement of said manual operating means in said second direction when said finger force exceeds the sum of said first force and said second force; and a reinforcing plate extending through a longitudinal plane and having an end portion offset adjacent said entry passage to accommodate entry of a belt tongue into the body member cavity with said end portion including a pair of legs extending away from said reinforcing plate and having a distal end means contacting said main body member limiting relative motion between said reinforcing plate and said main body member in a direction perpendicular to said plane.

* * * * *